US008002602B2

(12) United States Patent
Miura et al.

(10) Patent No.: US 8,002,602 B2
(45) Date of Patent: Aug. 23, 2011

(54) MANUFACTURING METHOD OF VACUUM AIRTIGHT CONTAINER

(75) Inventors: Tokutaka Miura, Yokohama (JP); Mitsutoshi Hasegawa, Yokohama (JP); Yoichi Ando, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 117 days.

(21) Appl. No.: 12/349,258

(22) Filed: Jan. 6, 2009

(65) Prior Publication Data

US 2009/0197498 A1 Aug. 6, 2009

(30) Foreign Application Priority Data

Jan. 31, 2008 (JP) ..... 2008-020796

(51) Int. Cl.
*H01J 9/00* (2006.01)

(52) U.S. Cl. ..... 445/25; 445/24; 313/495

(58) Field of Classification Search ..... 313/495–497; 445/24, 25, 41, 53, 55
See application file for complete search history.

(56) References Cited

U.S. PATENT DOCUMENTS

| | | | | |
|---|---|---|---|---|
| 5,688,708 | A | 11/1997 | Kato et al. | 437/51 |
| 6,396,207 | B1 | 5/2002 | Hasegawa et al. | 313/495 |
| 6,559,596 | B1 | 5/2003 | Arai et al. | 313/553 |
| 6,621,220 | B1 | 9/2003 | Hasegawa et al. | 313/634 |
| 6,652,343 | B2 | 11/2003 | Hasegawa et al. | 445/25 |
| 2003/0148696 | A1 * | 8/2003 | Kaneko et al. | 445/25 |
| 2006/0042748 | A1 | 3/2006 | Hasegawa et al. | 156/285 |

FOREIGN PATENT DOCUMENTS

| | | |
|---|---|---|
| EP | 0 817 234 | 1/1998 |
| EP | 0 996 141 | 4/2000 |
| FR | 2 771 549 | 5/1999 |
| JP | 64-31332 | 2/1989 |
| JP | 7-326311 | 12/1995 |
| JP | 9-320493 | 12/1997 |
| JP | 10-64457 | 3/1998 |
| JP | 2000-311588 | 11/2000 |
| JP | 2001-76650 | 3/2001 |

* cited by examiner

*Primary Examiner* — Bumsuk Won
(74) *Attorney, Agent, or Firm* — Fitzpatrick, Cella, Harper & Scinto

(57) ABSTRACT

A manufacturing method of a vacuum airtight container includes a baking step of baking, in a vacuum atmosphere, a container in which a first non-evaporable getter and a second non-evaporable getter having an activation temperature higher than that of the first non-evaporable getter are disposed. The baking step further includes steps of baking the entire container by increasing the temperatures of the container to a temperature T1 and holding the temperature T1, which is equal to or higher than an activation temperature of the first non-evaporable getter and is lower than an activation temperature of the second non-evaporable getter. After holding the temperature T1, the entire container is baked by increasing the temperature of the container to a temperature T2, which is higher than the activation temperature of the second non-evaporable getter.

8 Claims, 4 Drawing Sheets

T1: TEMPERATURE WHICH ACTIVATES NEG (1ST NEG 15) HAVING LOWER ACTIVATION TEMPERATURE

T2: TEMPERATURE WHICH ACTIVATES NEG (2ND NEG 27) HAVING HIGHER ACTIVATION TEMPERATURE

T1: TEMPERATURE WHICH ACTIVATES NEG (1ST NEG 15) HAVING LOWER ACTIVATION TEMPERATURE

T2: TEMPERATURE WHICH ACTIVATES NEG (2ND NEG 27) HAVING HIGHER ACTIVATION TEMPERATURE

MANUFACTURING METHOD OF VACUUM AIRTIGHT CONTAINER

BACKGROUND OF THE INVENTION

1. Field of the Invention

The present invention relates to a manufacturing method of a vacuum airtight container. More particularly, the present invention relates to a manufacturing method of a vacuum airtight container which is used in a flat panel image displaying apparatus.

2. Description of the Related Art

In recent years, sizes of screens to be used in image displaying apparatuses become larger. Conventionally, although CRTs (cathode-ray tubes) were the mainstream of the image displaying apparatuses, there was a problem that the CRT is large in size and heavy in weight. Consequently, a light and thin flat panel image displaying apparatus (called an FPD (flat panel display) hereinafter) has attracted attention.

In this connection, the FPD which is bright and contrasty, has a wide field angle, and can cope with demands of wider screens and higher definition has been developed.

In various types of FPDs which have been actively researched and developed in recent years, there is an LCD (liquid crystal display). In addition, a PDP (plasma display panel), an organic EL (electroluminescence) panel and the like have been developed.

The principle of light emission in the FPD is different from that in the CRT. However, on another front, an FPD which causes a fluorescent member to emit light by using an electron beam as well as the CRT has been developed.

Here, it should be noted that the FPD of this type includes an FED (field emission display) which is a display of a type of emitting electrons via an electric field by using as an electron source a cold cathode instead of a hot cathode. Further, as one kind of FED, there is a display that SCEs (surface-conduction electron emitters) are arranged in a matrix on a glass substrate. The display of this type, which is called an SED (surface-conduction electron emitter display), was proposed by the applicant of the present application {for example, see Japanese Patent Application Laid-Open No. S64-031332 (called a document 1 hereinafter) and Japanese Patent Application Laid-Open No. H07-326311 (called a document 2 hereinafter)}.

Since each of the FED and the SED uses electron beams, it is necessary to maintain a high vacuum inside the container, as well as the CRT. That is, a deterioration of vacuum (that is, an increase of pressure) influences image quality and a lifetime of the electron source.

In order to obtain a vacuum container of which vacuum is maintained excellently, a method of heating the inside of the container as exhausting it, and sealing the container after discharging the gas adsorbed to the inner surface of the container is conventionally used (this heating process is called a "baking process" hereinafter). Further, in order to maintain the vacuum of the container after the sealing, a method of disposing a metal thin film called a getter inside the container, and exhausting the container by using a gas adsorption action of the getter is conventionally used.

Roughly, the getter is classified into two kinds, that is, an evaporation getter and a non-evaporable getter (called an NEG hereinafter).

In the evaporation getter represented by Ba, a metal film evaporated to the inner surface of the container in vacuum is used as a pump as it is.

The evaporation getter is characterized in that a pump function can be exerted immediately after the evaporation process. On the other hand, since a getter film once evaporated cannot be exposed in the atmosphere, the processes from the evaporation process to the sealing process have to be consistently performed in vacuum. Further, in the evaporation getter, some kind or another energy means (a power conducting source, a high-frequency power source, or the like) other than heat in the baking process is typically necessary for the evaporation process.

On the other hand, in the NEG, a metal such as Ti, Zr or V or an alloy mainly consisting of Ti, Zr and V is formed on the inner surface of the container by evaporation, sputtering or the like. Here, the NEG is characterized to be able to be exposed in the atmosphere after it was formed. However, the NEG once exposed in the atmosphere cannot exert the performance as the pump. For this reason, it is necessary to heat the NEG in vacuum so as to obtain a temperature equal to or higher than the temperature at which the NEG exerts adsorption performance. The NEG can first exert the performance as the pump via such a heating process.

The above heating process for the NEG is called "activation". If the energy means such as the power conducting source, the high-frequency power source or the like is used as the heating means for activating the NEG, the activation can be selectively performed at arbitrary timing. Further, if an activation temperature is equal to or lower than a baking temperature, the NEG can be activated by the heat in the baking process. If the NEG can be activated by the heat in the baking process, specific means and process for activating the NEG can be omitted. Thus, it is desirable from the aspect of tact and cost.

In case of baking the vacuum container for the FPD (that is, in case of heating the container as exhausting it), since a conductance of exhaust is small because the container is thin, there is a possibility that the internal pressure of the container increases during the baking. More specifically, if the internal pressure of the container increases in a high-temperature state during the heating, there is a possibility in the FED and the SED that the electron source deteriorates. Thus, it is undesirable.

On the other hand, in a case where the NEG adopted as the getter is activated at the baking temperature, a gas discharged in the baking process is adsorbed (exhausted) by the NEG after the NEG was once activated. Consequently, since the pressure in the vacuum container decreases in the baking process, it is possible to suppress deterioration of the electron source due to the baking, and it is also possible to decrease the pressure in the vacuum container before the sealing is performed.

However, the operation that the discharged gas in the baking process is exhausted by the NEG implies that the NEG deteriorates in the baking process. Consequently, since the exhaust performance after the sealing, which is an essential object of the NEG, decreases, lifetime shortening or performance deterioration for each of the FED and the SED occurs.

To cope with such inconvenience, a technique for independently providing a getter to improve the pressure in the container in the baking process and a getter to be used to maintain the lifetime and the performance of each of the FED and the SED after the sealing is conventionally adopted.

Here, Japanese Patent Application Laid-Open No. 2001-076650 (corresponding to European Patent Application Publication EP 0996141A; called a document 3 hereinafter) discloses a method of providing an NEG within an image displaying area and further providing an evaporation getter or an NEG on the periphery of the image displaying area (this getter is called a peripheral getter hereinafter). However, in the document 3, in a case where the evaporation getter is adopted as the peripheral getter, a specific means (external energy) is necessary in order to evaporate the evaporation getter after activating the NEG in the image displaying area in a baking process. Moreover, in a case where the NEG is adopted as the peripheral getter, an NEG of the same kind as that of the NEG in the image displaying area (having the same activation temperature) or an NEG having an activation temperature higher than the temperature of the baking process is used.

If the kind of peripheral NEG is the same as that of the NEG in the image displaying area (namely, having the same activation temperature), both the peripheral NEG and the NEG in the image displaying area can be activated in the baking process. However, in such a case, since the peripheral NEG adsorbs the discharged gas in the baking process, the performance of the peripheral NEG deteriorates. Of course, the peripheral NEG can be later activated again. However, in this case, since a specific means (external energy) is necessary to do so, a new process occurs.

On the other hand, if the NEG having the activation temperature higher than the baking temperature is adopted, deterioration of the peripheral NEG in the baking process can be eliminated. However, even in this case, since a new means (external energy) is of course necessary for activation, a new process is necessary just the same.

Further, Japanese Patent Application Laid-Open No. H09-320493 (corresponding to French Patent Application Publication FR A1 2771549; called a document 4 hereinafter) discloses a method of providing two kinds of getters in a getter box provided in connection with a container. However, in the document 4, since one of these getters is the evaporation getter, a new means (external energy) and a new process for evaporation are necessary.

Furthermore, Japanese Patent Application Laid-Open No. H10-064457 (corresponding to European Patent Application Publication EP 0817234A; called a document 5 hereinafter) discloses a method of providing two kinds of NEGs respectively having different activation temperatures in a space provided in connection with a container. However, in the document 5, although the NEG having the lower activation temperature is activated in the baking process, it is necessary to selectively activate the NEG having the higher activation temperature by external energy after a baking process and a sealing process ended. Consequently, a new means (external energy) for the activation and an activation process other than the baking process are necessary.

Furthermore, Japanese Patent Application Laid-Open No. 2000-311588 (corresponding to U.S. Pat. No. 6,559,596; called a document 6 hereinafter) discloses laminated two kinds of NEGs provided within a displaying apparatus. In the document 6, the provided NEGs are heated and thus activated.

Conventionally, on the premise that the two kinds of getters are provided, the method of improving, on one hand, the pressure in the container by adsorbing the gas discharged in the baking process, and of maintaining, on the other hand, the pressure in the container after the sealing excellently and over the long term is adopted. However, to activate or evaporate either one of these two getters, the external energy other than the heat in the baking process is necessary, and also the specific process to do so is necessary.

SUMMARY OF THE INVENTION

The present invention aims to provide a manufacturing method of a vacuum airtight container, capable of activating a non-evaporable getter having a different activation temperature, without providing a process of giving external energy other than heat to be used in a baking process.

To achieve such an object, the manufacturing method of the vacuum airtight container according to the present invention comprises a baking step of baking, in a decompression atmosphere, a container in which a first non-evaporable getter and a second non-evaporable getter having an activation temperature higher than that of the first non-evaporable getter are disposed. In the manufacturing method of the airtight container according to the present invention, the baking step comprises a step of increasing the temperatures of the first and second non-evaporable getters up to a temperature T1 at which the first non-evaporable getter is activated, and thus activating the first non-evaporable getter. Further, the manufacturing method of the airtight container according to the present invention further comprises a step of, after activating the first non-evaporable getter, increasing the temperatures of the first and second non-evaporable getters up to a temperature T2, which is higher than the temperature T1 and at which the second non-evaporable getter is activated, and thus activating the second non-evaporable getter.

According to the present invention, it is possible to independently activate the first non-evaporable getter and the second non-evaporable getter only by the heat to be used in the baking process. Consequently, it is possible to activate the non-evaporable getter having the different activation temperature, without providing the process of giving external energy other than the heat to be used in the baking process.

Further features of the present invention will become apparent from the following description of the exemplary embodiments with reference to the attached drawings.

DESCRIPTION OF THE EMBODIMENTS

Hereinafter, the exemplary embodiments of the present invention will be described with reference to the attached drawings.

A manufacturing method of a vacuum airtight container of the present invention involves that of a vacuum airtight container used for an FPD. Especially, an FED and an SED are preferable modes, to which the present invention is applied, from a viewpoint that the inside of the vacuum airtight container has to be maintained at low-pressure. Hereinafter, the embodiments of the present invention will be specifically described by exemplifying the SED.

Figure 1:
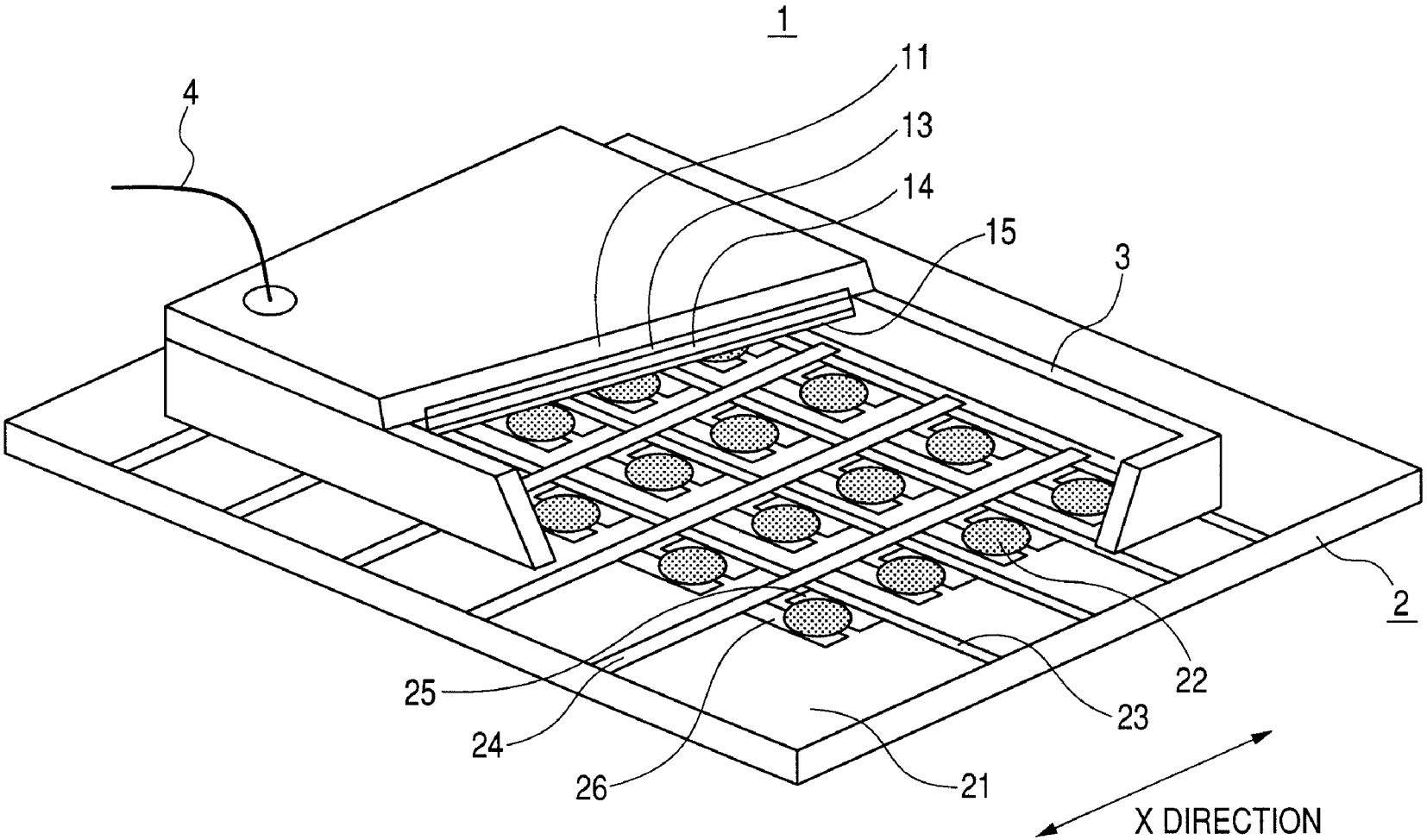
FIG. 1 is a perspective view, wherein an image display apparatus is partially broken, schematically indicating an example of constitution of the image display apparatus according to the present invention.

FIG. 1 is a perspective view, wherein an image display apparatus is partially broken, schematically indicating an example of constitution of the image display apparatus according to the present invention.

A front substrate 1, a rear substrate 2 and a support frame 3 are mutually bonded at joining areas by using a frit glass or a low-melting-point metal to form an envelope.

As for the front substrate 1, a fluorescent member (not illustrated in the drawing), a black matrix 13, a metal back 14 and an NEG 15 are formed on the inner surface of a front glass substrate 11, which serves as an image displaying area. As for the rear substrate 2, a plurality of electron-emitting devices (electron source) 22, X-wirings 23 and Y-wirings 24 are arranged on the inner surface of a rear glass substrate 21, and a part where the electron-emitting devices 22 are arranged is also called an image displaying area.

Figure 2:
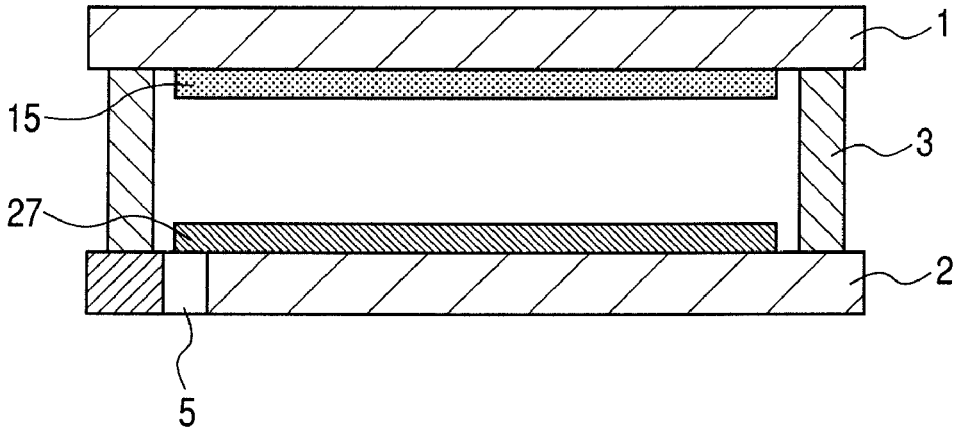
FIG. 2 is a schematic cross-sectional view of the image display apparatus according to the present invention.

FIG. 2 schematically indicates a constitutional cross section of the image display apparatus according to the present invention. The first NEG 15, which is a first non-evaporable getter, is located on the inner surface of the front substrate 1, and a second NEG 27, which is a second non-evaporable getter having an activation temperature different from that of the first NEG 15, is located on the inner surface of the rear substrate 2. That is, the image display apparatus of the present invention has the first non-evaporable getter having a low activation temperature and the second non-evaporable getter having the activation temperature which is higher than that of the first non-evaporable getter.

In FIG. 2, the constitutional members of the inner surfaces of the front substrate 1 and the rear substrate 2 other than those of the first NEG 15 and the second NEG 27 are omitted. An exhaust hole 5 used for exhausting the inside of a container is provided on the rear substrate 2, and the container becomes a vacuum airtight container by plugging the exhaust hole 5 by a sealing cover (not illustrated in FIG. 2) after exhausting the inside of the container by the exhaust hole 5. As a method of exhausting the inside of the container, it will be described later that a method is not limited to an exhaust hole.

As the first NEG 15 and the second NEG 27 to be located inside the container, the metal such as Ti (titanium), Zr (zirconium) or V (vanadium) or alloys consisted of main components of Ti, Zr and V can be usually selected. And, two metals or alloys having specific activation temperatures different from each other are selected from among them.

As a method of locating the first NEG 15 and the second NEG 27, there is a vapor deposition method or a sputtering method. And, the metal such as Ti, Zr or V or the alloy consisted of main components of Ti, Zr and V is previously applied onto the front substrate 1 or the rear substrate 2 as a thin film before forming the container. The metal or alloy can be also applied by a method such as a printing method or a lift-off method as another method. Note that the configuration of the NEG in a manufacturing method of the present invention is not limited to a metal thin film but a bulk getter formed by sintering the powdery material can be also applied.

As to locating positions of the first NEG 15 and the second NEG 27, the inner surface of the front substrate 1 or the second substrate 2 is preferable, that is, an image displaying area and its periphery are preferable. However, the locating positions are not limited to the above positions.

However, the first NEG 15 and the second NEG 27 should not be laminated and has to be located on different positions. And, it is considered that adsorption amounts and adsorption speed of the first NEG 15 and the second NEG 27 are proportional to the located areas of the first NEG 15 and the second NEG 27. Therefore, it is advantageous that the first NEG 15 and the second NEG 27 are located on areas as wide as possible. Furthermore, it is desirable that the first NEG 15 and the second NEG 27 are widely located on the inner surfaces of the substrates because an interspace between the front substrate 1 and the rear substrate 2 usually becomes narrow and the exhausting conductance becomes smaller in the FPD.

However, in case of using the above-mentioned metal thin film as the first NEG 15 and the second NEG 27, the inner surface of the film electrically becomes the low-resistance. For this reason, the first NEG 15 and the second NEG 27 can not be located so as to cover a space between the electrodes, where the insulating properties and the high-resistance are required, and a patterning process of masking portions undesirable to locate the NEG such that the NEG is not applied to such the portions is necessary.

In case of locating the NEG on the inner surface of the front substrate 1, if locating the NEG on an upper portion of the fluorescent member provided on the front substrate 1, there is possibility of deteriorating the luminance in an image display. And, it is possible to suppress the luminance deterioration by thinning film thickness of the NEG. However, since the adsorption amount of the NEG is decreased in proportion to an operation of thinning film thickness of the NEG, it is required that the NEG is not located on an upper part of the fluorescent member by the patterning in order to increase the film thickness and suppress the luminance deterioration.

After locating the NEG, the front substrate 1 is combined with the rear substrate 2 by the support frame 3 and these members are sealed by the adhesive to form a container. However, the exhaust hole 5 used for exhausting the inside of the container is previously provided on a part of the container. As a method of seal-bonding the members, a method of interposing the adhesive between the substrates and the support frame and thermally melting the adhesive to seal the members is general.

However, in a case that the NEG was located on the inner surface of the substrate by adopting a metal thin film such as Ti as the NEG, a surface of the NEG is oxidized if the temperature of the NEG is also increased in the atmosphere, and the adsorption performance is considerably deteriorated even if performing the activation later. Therefore, in case of melting the adhesive in the atmosphere, it is desirable that only the vicinity of the adhesive is locally heated to be sealed or a heating process is executed in an inert atmosphere such as an Ar (Argon) atmosphere to be sealed if the container is wholly heated in order that the temperature of a surface of the NEG is not increased.

After forming a container, a process advances to a baking process for that container. The formed container is located in a vacuum chamber having a mechanism of increasing temperature of the container and the chamber is exhausted. At this time, the inside of the container is also exhausted through the exhaust hole 5. When the pressure is decreased to a certain level, it is started to increase temperature of the container.

Figure 3:
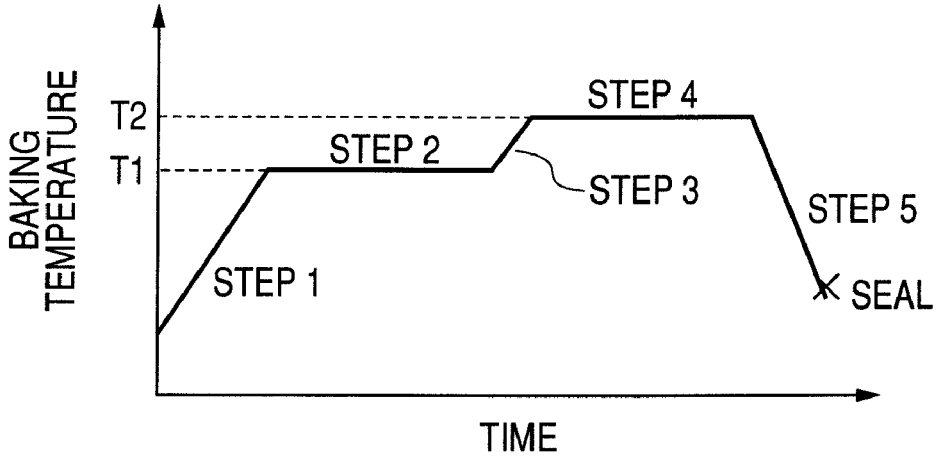
FIG. 3 is a graph indicating a temperature profile when executing a baking process in a manufacturing method of the image display apparatus of the present invention.

FIG. 3 indicates a temperature profile when executing the baking process in a manufacturing method of the image display apparatus of the present invention. Note that the activation temperature of the first NEG 15 is lower than that of the second NEG 27.

A STEP 1 is a step of increasing temperature to a temperature T1 of activating the first NEG 15. A STEP 2 is a step of maintaining the temperature T1 until the first NEG 15 is activated. A STEP 3 is a step of increasing temperature to a temperature T2 of activating the second NEG 27 after activating the first NEG 15. A STEP 4 is a step of maintaining the temperature T2 until the second NEG 27 is activated. A STEP 5 is a step of decreasing temperature after activating the second NEG 27. In the present invention, it is preferable to have the steps (STEP 2 and STEP 4) of maintaining the temperature at the activation temperature T1 of the first NEG 15 and the activation temperature T2 of the second NEG 27.

According to a manufacturing method of the present invention, it is able to have a time of sufficiently activating the first NEG 15 and decreasing the pressure inside the container before the second NEG 27 is activated by the STEP 2. In addition, it is able to obtain a time of sufficiently activating the second NEG 27 by the STEP 4.

In a process of activating the first NEG 15 to be executed in the STEP 2, it is important that the first NEG 15 is activated and at the same time the second NEG 27 is not too activated.

Here, with respect to the judgment of judging whether or not the NEG was activated, an exhaust speed of the NEG in the same temperature profile is previously measured, and then it is judged that a point of just exceeding a 70%-level of a maximum value of the obtained exhaust speed corresponds to a level of "activated".

When a value smaller than a 70%-level of the maximum value is selected for the judgment of activation, the performance of the NEG is not sufficiently brought out. On the other hand, when a value larger than a 70%-level of the maximum value is selected, a time required for the activation becomes long, and especially in a case of the first NEG 15, possibility of damaging the second NEG 27 appears. Therefore, in the present invention, the judgment of "activated" was fixed to about a level of 70%.

In order to judge that the second NEG 27 is not activated, this judgment was similarly treated to the judgment of activated. That is, the exhaust speed of the second NEG 27 in the same temperature profile is previously measured, and if the exhaust speed at a time when the first NEG 15 was activated is equal to or less than a 50%-level of the exhaust speed of the second NEG 27, the judgment of "not activated" was fixed.

The reason for adopting a level of 50% is due to a fact that it is considered that the damage to the second NEG 27 is not considerable even if the exhaust ability is arisen in the second NEG 27 because the pressure inside the vacuum airtight container is decreased by an exhaust operation of the first NEG 15 at a time when the first NEG 15 was activated. However, in order to bring out the exhaust ability of the second NEG 27 sufficiently, it is appropriate to suppress the exhaust speed of the second NEG 27 at a time when the first NEG 15 was activated to about a level of 50%.

However, since a time required until a maximum value of the exhaust speed is obtained is not identical depending on the kind of gas to be exhausted, the time and a temperature alteration rate for each of the STEP 2 and the STEP 4 should be selected according to the kind of gas remained inside the container. In addition, according to the judgment for the above-mentioned NEG activation, the STEP 2 and the STEP 4 are not always required to keep a constant temperature, but a temperature profile capable of activating only the first NEG 15 until when the second NEG 27 is activated may be adopted. For example, by separating the temperature alteration rates from the STEP 1 to the STEP 4, it can be also achieved to separate activation functions of the two NEGs.

The vacuum airtight container is formed by sealing the exhaust hole 5 by a sealing cover on the way of a process of decreasing the temperature executed in the STEP 5.

As a mode of sealing the container after exhausting the inside of the container, it is not limited to such a method of sealing the exhaust hole 5 by the sealing cover after exhausting the gas from the exhaust hole 5 in the vacuum chamber as described in the above description. The exhaust hole 5 is one of means used for exhausting the inside of the container after forming the container and an exhaust pipe can be used instead of the exhaust hole. In case of exhausting the inside of the container by the exhaust pipe, of course, the container is not required to be located in the vacuum chamber.

Although the above-mentioned two modes were cases that the container is previously seal-bonded and the inside of the container is exhausted from the exhaust hole or the exhaust pipe, the present invention can be further applied to a mode that the vacuum airtight container is formed by seal-bonding the container in the vacuum chamber.

A method of forming the vacuum airtight container by seal-bonding the container in the vacuum chamber is advantageous in the following point. That is, an interspace between the front substrate 1 and the rear substrate 2 can be widely saved just before seal-bonding the container, and an exhaust conductance between the substrates in the course of a baking process can be increased as compared with a case of performing the exhaust from the exhaust hole or the exhaust pipe after previously seal-bonding the container.

However, when an interspace between the substrates is widely saved, since a size of an apparatus becomes larger especially in case of intending to fabricate a large number of containers at the same time, there is a request of intending to make the interspace between the substrates in the vacuum chamber as narrow as possible. A case that an interspace between the substrates becomes narrow and the exhaust conductance between the substrates becomes smaller is equivalent to a case that the gas is exhausted from the exhaust hole, and the present invention becomes effective.

As described above, a manufacturing method of the vacuum airtight container in the present embodiment adopts such a temperature profile, where the second non-evaporable getter is activated after only the first non-evaporable getter was activated by setting a time lag in a baking process. Accordingly, since the second non-evaporable getter having a high activation temperature can be activated in a preferable atmosphere of a low-pressure by a pumping action of the first non-evaporable getter at the activation temperature previously activated, the deterioration at a time of baking the second non-evaporable getter can be suppressed. Therefore, the getter adsorption amount after the sealing increases and an excellent getter performance can be maintained for a long time.

In addition, a manufacturing method of the vacuum airtight container in the present embodiment can independently activate the first non-evaporable getter and the second non-evaporable getter respectively by only the heat generated in the baking process. In this manner, since the activation of the each non-evaporable getter can be finished in the baking process, a process only for the activation is not separately required.

In addition, an image display apparatus of using the container which was manufactured by a manufacturing method of the vacuum airtight container in the present embodiment can extend its life-span as compared with the conventional image display apparatus. This effect depends on a fact that the damage to electron-emitting devices by the remaining gas can be decreased because the second non-evaporable getter can maintain an excellent getter performance for a long time after the sealing.

In addition, the container which was manufactured by the manufacturing method of the vacuum airtight container in the present embodiment can realize a smaller and flatter image display apparatus at a low cost. This effect depends on a fact that a space or an area for the getter has not to be separately provided other than the front substrate or the rear substrate because the getter is activated by only the temperature increasing process at a time of executing the baking process.

EMBODIMENTS

Hereinafter, the present invention will be described in detail by exemplifying the specific embodiments.

Embodiment 1

In the present embodiment, a process of applying the present invention will be described in detail by exemplifying an SED indicated in FIG. 1.

(1) Front Substrate Forming Process

As a front glass substrate 11, a glass PD-200 (produced by ASAHI Glass Co., Ltd), of which thickness is 2.8 mm, containing few alkaline component was used. After sufficiently cleaning the glass substrate, an ITO (Indium-Tin Oxide) is deposited 100 nm on this glass substrate by a sputtering method and then a transparent electrode was formed. Subsequently, a fluorescent film is applied by a printing method and a smoothing process of a surface called "filming" is executed and then a fluorescent member was formed. Note that a stripe-like fluorescent member, which was comprised of three colors of red, green and blue, was formed as the fluorescent member. In addition, a matrix structure (black matrix) composed of a black conductive material was also provided. The number of pixels is 720×160 pixels by treating a couple of red, green and blue as one pixel. Furthermore, a metal back 14, of which thickness is about 100 nm, consisted of a thin aluminum film was formed on the fluorescent member and a black matrix 13 (whole surface of image display unit) by an electron beam vapor deposition method. A filming agent was eliminated by baking it in the atmosphere after forming the metal back. Note that a wiring used for electrically connecting the metal back 14 with a high-voltage terminal 4 was previously formed by the printing of an Ag-paste and the baking.

(2) NEG Forming Process Executed onto Front Substrate

After eliminating the filming agent, a Ti film, of which thickness is about 350 nm, corresponding to the second NEG 27 was formed on the front substrate 1 by the electron beam vapor deposition method. At this time, in order to prevent the luminance deterioration due to the Ti film, a fluorescent member part was previously masked by a metal mask and the Ti was set to be vapor deposited on only a part extending to the X-direction of the black matrix.

(3) Rear Substrate Forming Process

As a rear glass substrate 21, the glass PD-200 (produced by ASAHI Glass Co., Ltd), of which thickness is 2.8 mm, serving as a high strain point glass is used, and a member formed by further applying $SiO_2$ film, of which thickness is 100 nm, serving as a sodium block layer onto this glass PD-200 and performing the baking was used.

Device electrodes 25 and 26 were formed by such a manner, where the titanium, of which thickness is 5 nm, is initially deposited on the glass substrate 21 as an undercoating layer, on which the platinum, of which thickness is 40 nm, is deposited by a sputtering method and then the patterning is performed by a series of photolithography method including such steps of an exposure, a development and an etching upon applying the photoresist.

Next, a Y-wiring 24 was formed with a state of line-like pattern designed to contact with one side of each of the device electrodes and combine these device electrodes. As the material, an Ag photo paste ink is used. And, after performing the screen printing, the printed ink is dried and then a developing process was executed upon performing the exposure to obtain a predetermined pattern. Thereafter, a baking process was executed at the temperature 480° C. and the wiring was formed.

Thickness of the wiring is about 10 μm and width is about 50 μm. Note that since an end terminal is used as a wiring extraction electrode, the width was set to become wider. Next, an interlayer insulation layer used for insulating the X-wiring 23 and the Y-wiring 24 was arranged. The insulation layer was arranged under the X-wiring 23 so as to cover a point where the X-wiring 23 and the former formed Y-wiring 24 are intersected and was formed by opening a contact hole on a connection part such that the X-wiring 23 can be electrically connected with other sides of the device electrodes 25 and 26.

As for the subsequent processes, an exposure process and a developing process were executed after printing a photosensitive glass paste containing a main component of PbO (lead oxide) by a screen printing method. Thereafter, the above processes are repeated four times and then a baking process was executed at the temperature 480° C. at the last. Thickness of the interlayer insulation layer is about 30 μm and width is about 150 μm in whole. The X-wiring 23 was formed by such a manner, where an Ag paste ink is dried after printing the Ag paste ink on the former formed insulation layer by the screen printing method and the similar process is executed again on this dried ink then a baking process is executed at the temperature 480° C. after performing the twice coating. The X-wiring 23 is intersected with the Y-wiring 24 across the above-mentioned insulation layer and connected with the other side of the device electrode at a portion of a contact hole of the insulation layer. The other sides of the device electrodes are combined by the X-wiring 23 to be operated as scanning electrodes after forming a panel. Thickness of the X-wiring 23 is about 15 μm. Note that the exhaust hole 5, of which a diameter is 10 mm, is previously provided on a portion, where the wiring outside an image displaying area (device electrode portion) of the rear glass substrate 21 is not formed.

(4) Device Film Applying Process

An electron-emitting devices (device film) 22 was applied between the device electrodes 25 and 26 by an ink-jet method. As the device film, a liquid solution containing organopalladium obtained by dissolving a palladium-proline complex, of which the concentration is 0.15 Wt %, into a water solution consisted of water and isopropyl alcohol (IPA) at a ratio of 85:15 was used. Thereafter, the substrate was baked at the temperature 350° C. for ten minutes in the air and a palladium oxide (PdO) was obtained. A diameter of the device film is about 60 μm and thickness is 10 nm at a maximum level.

(5) Device Film Forming Process

For the formed device film 22, a gap of several-nm was formed inside the device film by an energization process called a forming to be executed in a reductive atmosphere and an electron-emitting portion was formed. Especially, a cover member is put so as to cover the whole substrate while remaining an extraction electrode part (periphery of the X-wiring 23 and the Y-wiring 24) around the rear substrate 2. The cover member is connected with a vacuum exhaust system and a gas introduction system, and it is constituted that the low-pressure hydrogen gas can be filled in the inside part. A gap of several-nm is formed inside the conductive thin film by applying the voltage to a space between the X wiring and the Y wiring from an electrode terminal by an external power source in a low-pressure hydrogen gas space and energizing a space between the device electrodes, and an electron-emitting portion in a state of the electric high-resistance is formed. At this time, a reduction action is accelerated by the hydrogen, and the palladium oxide (PdO) is changed to a palladium (Pd) film.

(6) Device Activation

Since the device film in a state after completing the forming process is such a film of having an extremely low electron-emitting efficiency, a process called "device activation" is executed in order to increase the electron-emitting efficiency. This process is executed by repeatedly applying the pulse voltage to the device electrode from an external through the X and Y wirings after producing a vacuum space of having appropriate pressure and containing the organic compound in its inside by putting a cover member similarly to a process of the above-mentioned device film forming. According to this process, a carbon or a carbon compound originating from the organic compound is deposited on the vicinity of the above-mentioned fissure (gap) as a carbon film. In this process, a tolunitrile is used as a carbon source to be introduced into a vacuum space through a slow leak valve, and the voltage is applied with a state of maintaining a pressure of $1.3\times10^{-4}$ Pa.

(7) NEG Forming Process Executed onto Rear Substrate

After completing the device activation, TiZr serving as the first NEG 15, of which thickness is about 350 nm, was formed on an image displaying area of the rear substrate 2 by an electron beam vapor deposition method. Compositional ratios of Ti and Zr in the vapor deposited film were about 50% to 50%. When performing the vapor deposition, a masking process is executed by using a metal mask so as to be performed a vapor deposition on only the Y-wiring 24. This process is executed in order to prevent an inconvenience that a circuit is shorted if a film of the first NEG 15 adheres to portions, where the potential difference is generated, placed on the device electrodes 25 and 26, a gap between the device electrodes of the electron-emitting devices 22 or the X-wiring 23 and the Y-wiring 24.

(8) Spacer Setting Process

Subsequently, five support members (spacers) composed of the glass, of which height is 1.8 mm, thickness is 0.2 mm and length is 180 mm, were set with the same interval on the Y-wiring 24 within an image displaying area of the rear substrate 2 in order to obtain the structure that the vacuum airtight container can withstand the atmospheric pressure.

(9) Sealing Material (Low-Melting-Point Metal) Applying Process

The front substrate 1 and the rear substrate 2 are put on a hot plate heated up to about 110° C., and an indium (melting point: 157° C.) melted in an electric crucible was applied on seal-bonding portions on the peripheries of image displaying areas of the respective front substrate 1 and the rear substrate 2 by using a nozzle, of which a bore diameter is about 4 mm, oscillated by an ultrasonic wave. The height of the shaped indium is about 0.3 mm. Note that a seal-bonding portion on the periphery of the image displaying area of the rear substrate 2 is coated by an insulation layer such that a space between the wirings is not electrically shorted by the indium.

(10) Substrate Alignment Process

The support frame 3, of which width is 8 mm and height is 1.5 mm, formed by the glass PD-200 is interposed between seal-bonding portions of the front substrate 1 and the rear substrate 2 to which the indium was applied, and four sides of the front substrate 1 and the rear substrate 2 are fixed by nipping with use of clips after performing the alignment of the front substrate 1 and the rear substrate 2.

(11) Seal Bonding Process

The seal bonding process was executed by energizing the indium between the front substrate 1 or the rear substrate 2 and the support frame 3 and melting the indium. Initially, in order to seal and bond the rear substrate 2 with the support frame 3, the copper plate electrodes are inserted in two positions opposite to the indium part between the rear substrate 2 and the support frame 3. The rear substrate 2 was seal-bonded with the support frame 3 by flowing a current of 70 A for two minutes between these electrodes. Also as to a process of seal-bonding the front substrate 1 with the support frame 3, the copper plate electrodes are inserted in two positions opposite to the indium part between the front substrate 1 and the support frame 3, and the front substrate 1 was seal-bonded with the support frame 3 by the same condition as that in the above-mentioned process.

(12) Baking Process

The seal-bonded substrates are baked in a vacuum chamber having a substrate heating mechanism and a sealing mechanism of sealing an exhaust hole under the pressure decreased atmosphere. The hot plates are provided on upper and lower portions in the vacuum chamber, and several pins, of which height are respectively about 10 mm, used for supporting the substrate are vertically stood on surfaces of the hot plates to have the structure capable of nipping the substrate from upper and lower sides. A melting point of the indium serving as the seal bonding material is 157° C., which is lower than the baking temperature, therefore there is a possibility that the substrates seal-bonded with each other after performing the alignment get to move in the temperature equal to or higher than a melting point of the indium at a time of performing the baking. Consequently, the substrates are controlled not to move each other by baking the substrates with a state of nipping them by the hot plates.

As to the baking temperature, a temperature T2 was initially set to 350° C. as the temperature of activating Ti serving as the NEG (second NEG 27) having the higher activation temperature. And, when the adsorption speed of the Ti at a time of fixing the temperature to 350° C. was measured, the exhaust speed reached a 70%-level of a maximum value after elapsing about eight minutes when the temperature was fixed to 350° C. for the nitrogen ($N_2$) or the carbon monoxide (CO) as indicated in FIG. 4.

And, it was understood that the exhaust speed reached a 70%-level of a maximum value after elapsing about fifteen minutes for the water ($H_2O$). According to this fact, it was considered that the Ti was activated if a time for holding the temperature T2 is equal to or longer than fifteen minutes. However, a time for holding the temperature T2 was set to sixty minutes for the purpose of sufficiently decreasing the pressure inside the container and maximizing the exhaust speed of water.

Figure 4:
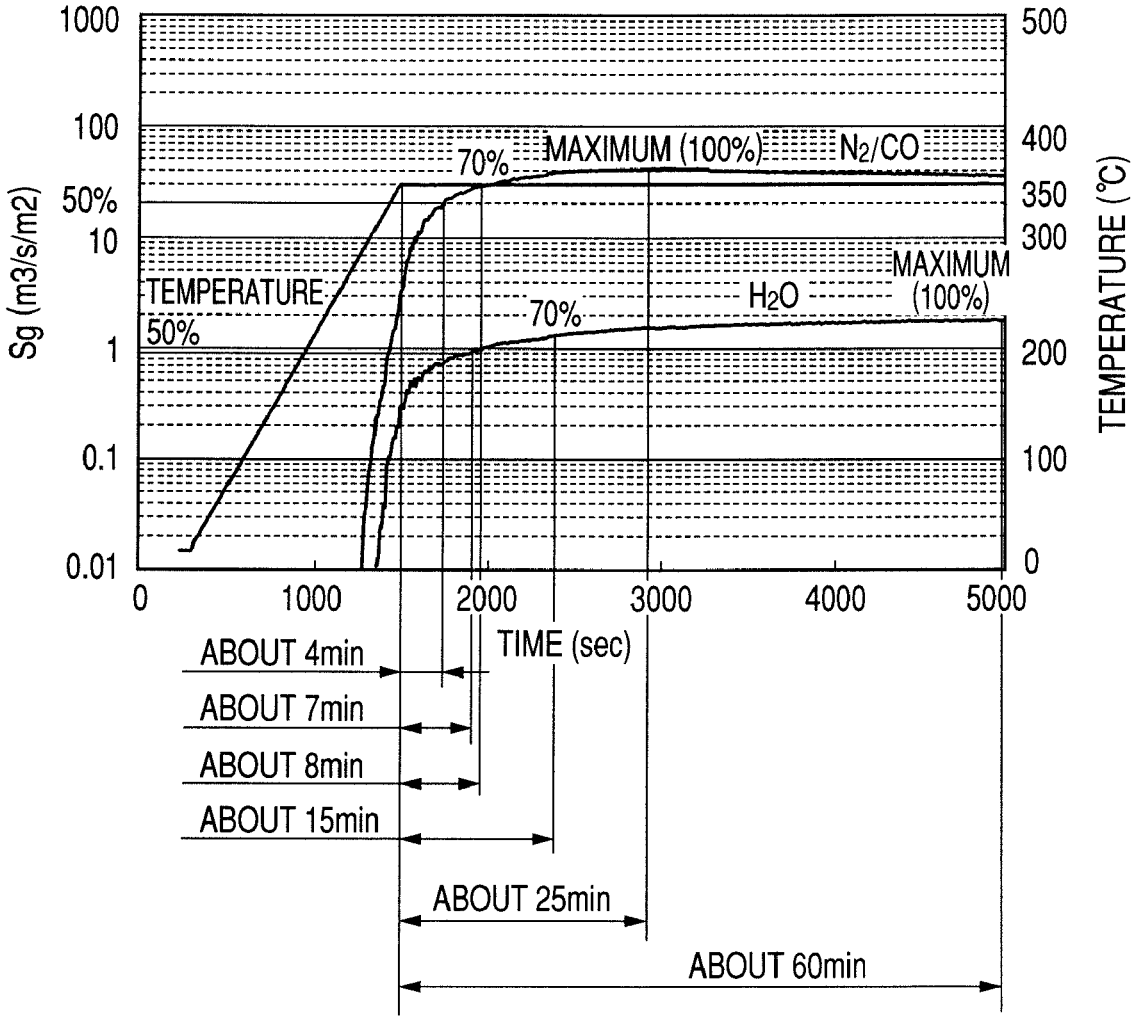
FIG. 4 is a graph indicating an activation condition of a Ti (titanium) getter serving as a second non-evaporable getter when a temperature T2 was set to 350° C. in the baking process.

As indicated in FIG. 4, a maximum value of the exhaust speed of the second NEG 27 for the nitrogen or the carbon monoxide is about 40 ($m^3/s/m^2$), and a maximum value of the exhaust speed for the water is about 2 ($m^3/s/m^2$). A temperature rise rate of rising the temperature from T1 to T2 was set to 20° C./min. As to the temperature T1, the temperature 300° C. was selected as the temperature of activating the TiZr and not activating the Ti.

When the adsorption speed of the TiZr at a time of fixing the temperature to 300° C. was measured, it was understood that the exhaust speed reached a 70%-level of a maximum value after respectively elapsing about ten minutes and thirty minutes when the temperature was fixed to 300° C. for the nitrogen or the carbon monoxide and the water. Therefore, with respect to the TiZr, a time for holding the temperature T1 was set to thirty minutes. Note that a temperature rise rate was set to 20° C./min.

Figure 5:
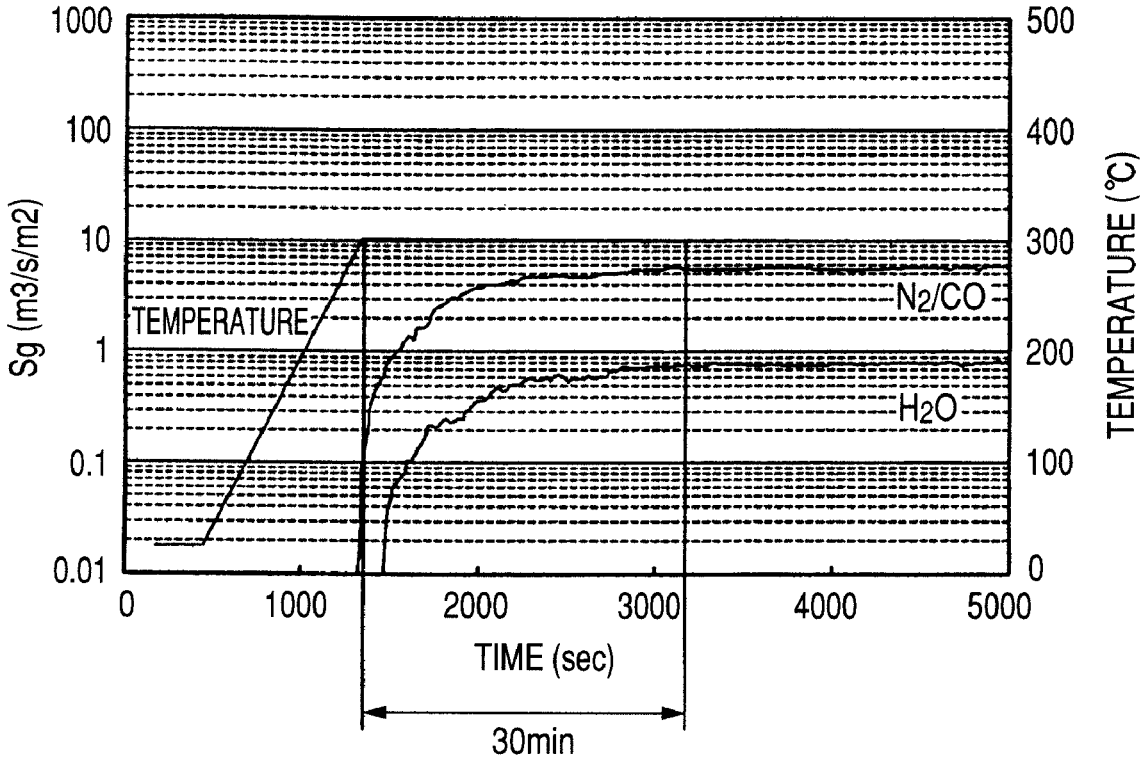
FIG. 5 is a graph indicating an activation condition of the Ti getter serving as the second non-evaporable getter when a temperature T1 was set to 300° C. in the baking process.

FIG. 5 indicates an activation condition of the Ti getter serving as the second NEG 27 at the temperature T1 (300° C.). The exhaust speed of the second NEG 27 for the nitrogen or the carbon monoxide when holding the temperature for thirty minutes at the temperature T1 is about 5 ($m^3/s/m^2$) and the exhaust speed for the water is about 0.8 ($m^3/s/m^2$). Like this, it is obvious that each of the above speeds is less than a 50%-level of a maximum value of the exhaust speed.

Then, after holding the temperature T2 (350° C.) for sixty minutes, it was started to decrease temperature.

(13) Sealing Process

A sealing cover is formed by processing the plate glass PD-200, of which thickness is 2.8 mm, into a 30 mm-square and the indium is previously applied to an area along the periphery of the cover. This sealing cover, which is located in the chamber together with the substrate, is set to be pressed to an exhaust hole by a vertical moving mechanism and further set to be controlled to reach the same temperature as that of the substrate by a heater.

After starting to decrease the temperature, the sealing cover is pressed to a portion at the exhaust hole 5 of the substrate when the temperature of the substrate is decreased to 200° C., and the sealing was completed by plugging the exhaust hole. After completing the sealing, the nitrogen is introduced in the vacuum chamber when the temperature is decreased to 100° C. or less than 100° C., and the substrate is removed from the vacuum chamber after returning the inside condition to the atmosphere pressure.

The vacuum chamber formed by the above-mentioned process is built in a cage together with a drive circuit, and when an SED is driven after forming the SED serving as an image display apparatus, a preferable life-span characteristic was obtained as compared with the conventional constitution of arranging the Ti also in the rear substrate.

Embodiment 2

This embodiment is same as the Embodiment 1 excepting that the increasing of temperature in the baking process is performed to increase temperature from the room temperature to the temperature T2 (350° C.) with a temperature increasing rate of 2° C./min without a hold time of holding the temperature T1 (300° C.) and the temperature T2 is held for an hour. When an SED according to this embodiment is driven, a preferable life-span characteristic was obtained as compared with the conventional constitution of arranging the Ti also in the rear substrate.

Comparative Example

This comparative example is same as the Embodiment 1 excepting that the increasing of temperature in the baking process is performed to increase temperature from the room temperature to the temperature T2 (350° C.) with a temperature increasing rate of 20° C./min without a hold time of holding the temperature T1 (300° C.) and the temperature T2 is held for an hour. When an SED according to this comparative example is driven, only the life-span characteristic having a similar level to that in the conventional constitution was obtained.

As indicated in FIG. 4, the exhaust speed of the second NEG 27 for the $N_2$ and the CO reaches a 50%-level of a maximum value of the exhaust speed in only four minutes and the exhaust speed for the $H_2O$ reaches a 50%-level of a maximum value of the exhaust speed in only seven minutes. That is, it was considered that the exhaust speed of the second NEG 27 (Ti) reached a 50%-level of the maximum value before the first NEG 15 (TiZr) is activated and quality in the life-span characteristic was deteriorated.

Embodiment 3

This embodiment is the same as Embodiment 1 except that both the first NEG 15 (TiZr) and the second NEG 27 (Ti) were vapor deposited in a process of forming the NEG onto the front substrate instead of a process of forming the NEG onto the rear substrate and omitting the process of forming the NEG onto the rear substrate. However, the first NEG 15 and the second NEG 27 were vapor deposited such that they are mutually placed on every other line in the X-direction of the black matrix 13.

When an SED according to this Embodiment is driven, although the life-span is slightly deteriorated as compared with the Embodiment 1, a preferable life-span characteristic was obtained as compared with the conventional constitution of only arranging the Ti.

Embodiment 4

This embodiment is same as the Embodiment 3 excepting that the support frame 3 is previously fixed to the rear substrate 2 by a low-melting-point glass (glass frit (LS7305) produced by Nippon Electric Glass Co., Ltd) and the indium was applied onto the support frame 3 fixed to the rear substrate in a process of applying the seal bonding material (low-melting-point metal).

When an SED according to this Embodiment is driven, although the life-span is slightly deteriorated as compared with the Embodiment 1, a preferable life-span characteristic was obtained as compared with the conventional constitution of only arranging the Ti.

Embodiment 5

This embodiment was similarly carried out to the Embodiment 1 until a process of applying the seal bonding material (low-melting-point metal) by using a member of not having the exhaust hole on the rear substrate 2. After applying the indium, the front substrate 1 and the rear substrate 2 were respectively located in the vacuum chamber with a state of putting the support frame 3 on a seal bonding portion of the rear substrate 2 without routing through a substrate alignment process and a seal bonding process.

Hot plates are placed on vertically opposite positions in this vacuum chamber, and it is set that the substrates are oppositely located each other in a manner that the front substrate 1 is located on an upper hot plate and the rear substrate 2 is located on a lower hot plate. Note that the hot plates move in vertical. After exhausting the inside of the chamber to become a vacuum state, a position of the upper hot plate is adjusted such that an interspace between the front substrate 1 and the support frame 3 becomes a distance of 10 mm and a process of increasing the temperature was started. It is assumed that a temperature increasing profile is same as that in the Embodiment 1, and the upper hot plate is dropped at a timing of the sealing in the Embodiment 1 to press the front substrate 1 to the support frame 3, and the front substrate 1 is seal-bonded with the rear substrate 2 through the support frame 3. When an SED according to this Embodiment is driven, a preferable life-span characteristic was obtained as compared with the conventional constitution of arranging the Ti also in the rear substrate.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-020796, filed Jan. 31, 2008, which is hereby incorporated by reference herein in its entirety.

What is claimed is:

1. A manufacturing method of a vacuum airtight container, the method comprising:

a sealant applying step of applying a sealing material to a container;

a baking step of baking, in a vacuum atmosphere, the container in which a first non-evaporable getter and a second non-evaporable getter having an activation temperature higher than that of the first non-evaporable getter are disposed; and a sealing step of, after the baking step, sealing the container with the sealing material to provide an airtight container, wherein the baking step comprises steps of:

baking the entire container by increasing the temperature of the container up to a temperature T1 and holding the temperature T1 for a period of time, with temperature T1 being equal to or higher than the activation temperature of the first non-evaporable getter and lower than the activation temperature of the second non-evaporable getter;

after holding the temperature T1, baking the entire container by increasing the temperature of the container up to a temperature T2, which is higher than the activation temperature of the second non-evaporable getter and a melting point of the sealing material; and decreasing the temperature of the container from the temperature T2 to a temperature which is lower than the melting point of the sealing material.

2. A manufacturing method according to claim 1, further comprising a step of forming the container by sealing a front substrate having a fluorescent member for displaying images and a rear substrate having an electron-emitting device for emitting electrons with a support frame as maintaining a predetermined interval.

3. A manufacturing method according to claim 2, wherein either one of the first non-evaporable getter and the second non-evaporable getter is applied to the front substrate and the other of the first non-evaporable getter and the second non-evaporable getter is applied to the rear substrate.

4. A manufacturing method according to claim 1, wherein holding the temperature T1 of the container makes an exhaust speed of the first non-evaporable getter achieve a 70%-level of a maximum value of the exhaust speed of the first non-evaporable getter, and suppresses an exhaust speed of the second non-evaporable getter under a 50%-level of a maximum value of the exhaust speed of the second non-evaporable getter.

5. A method of manufacturing a vacuum airtight container, comprising:

a sealant applying step of applying a sealing material to a container;

a baking step of baking, in a vacuum atmosphere, the container having a first non-evaporable getter and a second non-evaporable getter with an activation temperature higher than that of the first non-evaporable getter; and a sealing step of, after the baking step, sealing the container with the sealing material to provide an airtight container, wherein the baking step comprises steps of:

baking the entire container by increasing the temperature of the container to a temperature T1, which is equal to or higher than the activation temperature of the first non-evaporable getter and lower than the activation temperature of the second non-evaporable getter;

maintaining the container at the temperature T1 for a period of time to sufficiently activate the first non-evaporable getter;

increasing the temperature of the container from a temperature T1 to a temperature T2, which is higher than the activation temperature of the second non-evaporable getter and a melting point of the sealing material;

maintaining the container at the temperature T2 for a period of time to sufficiently activate the second non-evaporable getter; and decreasing the temperature of the container from the temperature T2 to a temperature which is lower than the melting point of a sealing material, wherein activation of the second non-evaporable getter is completed before completing sealing of the container.

6. A manufacturing method according to claim 5, further comprising a step of forming the container by sealing a front substrate having a fluorescent member for displaying images and a rear substrate having an electron-emitting device for emitting electrons with a support frame as maintaining a predetermined interval.

7. A manufacturing method according to claim 6, wherein either one of the first non-evaporable getter and the second non-evaporable getter is applied to the front substrate and the other of the first non-evaporable getter and the second non-evaporable getter is applied to the rear substrate.

8. A manufacturing method according to claim 5, wherein maintaining the temperature T1 of the container makes an exhaust speed of the first non-evaporable getter achieve a 70%-level of a maximum value of the exhaust speed of the first non-evaporable getter, and suppresses an exhaust speed of the second non-evaporable getter under a 50%-level of a maximum value of the exhaust speed of the second non-evaporable getter.

* * * * *